US006461126B2

(12) United States Patent
Pierobon

(10) Patent No.: US 6,461,126 B2
(45) Date of Patent: Oct. 8, 2002

(54) COMPRESSOR IN AN AIRTIGHT REFRIGERATING UNIT WITH IMPROVED VALVE SYSTEM

(75) Inventor: Emilio Pierobon, Belluno (IT)

(73) Assignee: Zanussi Elettromeccanica S.p.A., Pardenone (IT)

( * ) Notice: Subject to any disclaimer, the term of this patent is extended or adjusted under 35 U.S.C. 154(b) by 0 days.

(21) Appl. No.: 09/742,724

(22) Filed: Dec. 21, 2000

(65) Prior Publication Data

US 2001/0007637 A1 Jul. 12, 2001

(30) Foreign Application Priority Data

Dec. 30, 1999 (IT) ..... PN99U0056

(51) Int. Cl.[7] ..... F04B 39/10; F04B 53/10
(52) U.S. Cl. ..... 417/569; 417/571; 137/855
(58) Field of Search ..... 417/569, 571; 137/855, 454.4

(56) References Cited

U.S. PATENT DOCUMENTS

| | | | | | |
|---|---|---|---|---|---|
| 5,209,260 | A | * | 5/1993 | Baek | 137/527 |
| 5,266,016 | A | * | 11/1993 | Kandpal | 417/569 |
| 5,456,287 | A | * | 10/1995 | Leu | 137/855 |
| 5,558,508 | A | * | 9/1996 | Sasano et al. | 417/569 |
| 6,053,713 | A | * | 4/2000 | Brown | 417/571 |
| 6,113,369 | A | * | 9/2000 | Selway | 417/569 |
| 6,227,825 | B1 | * | 5/2001 | Vay | 417/569 |

* cited by examiner

*Primary Examiner*—Charles G. Freay
*Assistant Examiner*—Han Lieh Liu
(74) *Attorney, Agent, or Firm*—Pearne & Gordon LLP

(57) ABSTRACT

A compressor including a valve plate held between the body and the head with the interposition of a first and a second flat sealing gasket. The compressor further includes a thin-sheet aspiration valve associated with an aspiration hole provided on the valve plate. The entire valve is accommodated within a recessed area provided on a surface of the valve plate that is turned toward the body of the compressor.

3 Claims, 3 Drawing Sheets

COMPRESSOR IN AN AIRTIGHT REFRIGERATING UNIT WITH IMPROVED VALVE SYSTEM

FIELD OF THE INVENTION

The present invention generally concerns compressors of the type employed in airtight refrigerating units in household and similar apparatus, and particularly valve systems used therein.

BACKGROUND OF THE INVENTION

The numerous governmental regulations, such as the Directives of the European Union, which impose increasingly strict limits on the efficiency of household appliances, have become a ever more critical factor in refrigeration design. Energy consumption by refrigeration appliances is largely dependent upon the overall yield of the refrigerating unit, which in turn depends not only on the efficiency of the electric motor that operates it and the mechanical yield of the compressor itself, but also on the volumetric yield of the compressor. The valve system of the compressor plays a significant part in this determination.

With regard to aspiration type valves, which are of the thin-plate or reed type, it is well known how to fabricate them, using a process involving shearing steel ribbon and successive machining, so as to provide valves that are flush with a compressor's valve plate. The anchoring portion of the valve is permanently sealed, by at least one flat sealing gasket, between the plate and the cylinder body. This method is, however, less cost efficient than traditional valve systems due to the high tolerance requirements for the aspiration valve resulting in a less reliable valve and a higher cost of manufacture.

Another known method is fabricating an aspiration valve such that its anchoring portion includes creased tabs, whose edges are anchored in corresponding indentations in the valve plate, such as is disclosed in patent application WO 99/30037. While the sensitivity of the valve to tolerance is less important, this method instead requires a very precise machining of the body of the compressor to accommodate the anchoring portion of the valve (excluding the edges of the tabs) and of the head of the piston to accommodate the main portion of the valve in such a way as to minimize the wasted volume of the compressor.

It would therefore be desirable to devise an improved aspiration valve system for such refrigeration compressors, so as to increase the volumetric yield of the compressor, and consequently the overall yield of the airtight unit, while also simplifying the manufacturing process.

SUMMARY OF THE INVENTION

Provided according to one aspect of the present invention is a compressor for an airtight refrigerating unit comprising a cylinder body, a compressor head, a valve plate held between the cylinder body and the compressor head with the interposition of a first flat sealing gasket and a second flat sealing gasket, and a thin-sheet aspiration valve associated with an aspiration hole provided on the valve plate. The entire aspiration valve is substantially accommodated within a recessed area provided on a surface of the valve plate that is directed toward the cylinder body.

According to another aspect of the present invention, the recessed area comprises a main area which accommodates a main portion of the aspiration valve, and at least one other area of indentation having a depth greater than the depth of the main area. This other indentation is capable of accommodating an anchoring portion of the aspiration valve.

According to yet another aspect of the present invention, the aspiration valve does not substantially protrude into the cylinder, thus potentially providing an increase in usable cylinder volume and in turn an increase in overall compressor efficiency.

According to still another aspect of the present invention, the aspiration valve is a generally T-shaped flat tongue. This flat tongue comprises an elongated main portion having a free rounded end that is capable of sealing the aspiration hole of the valve plate, and a transverse anchoring portion that comprises at least one creased tab.

DETAILED DESCRIPTION OF THE INVENTION

Figure 1:
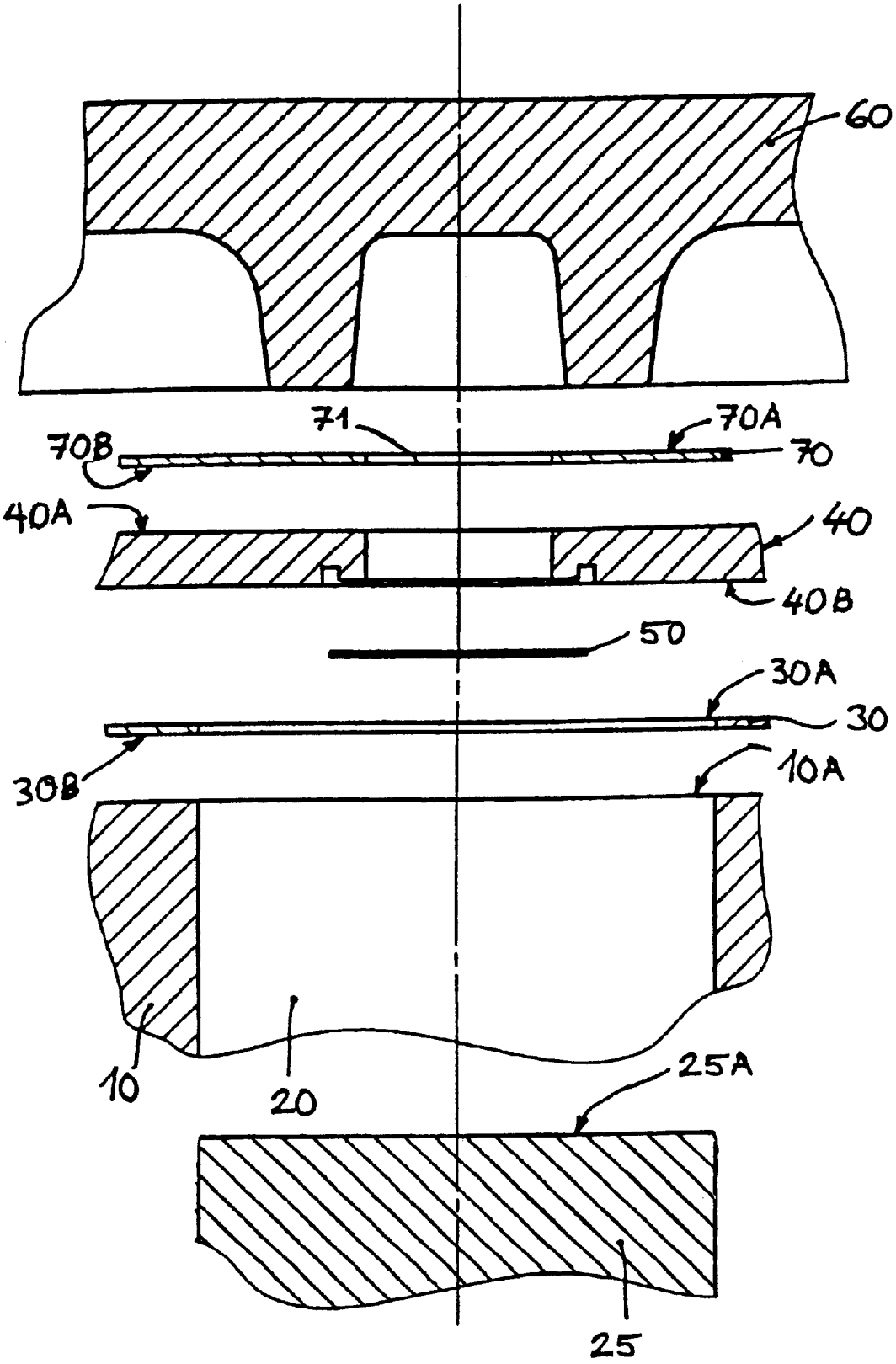
FIG. 1 is a partial section of a compressor of an airtight refrigerating unit according to the present invention.

FIGS. 1–6 illustrate a partial structure of a single cylinder compressor of an airtight refrigerating unit that comprises an electric motor (not shown), a cylinder body 10, a cylinder 20 adapted to accommodate a piston 25, a first flat sealing gasket 30, a valve plate 40, an aspiration valve 50, a compressor head 60 and a second flat sealing gasket 70.

The first flat sealing gasket 30 has top and bottom surfaces 30A, 30B. The gasket 30 is generally circular in shape and has an interior diameter that is the approximately equal to the outside diameter of the cylinder 20.

The valve plate 40 has top and bottom surfaces 40A, 40B. The plate 40 is provided with exhaust holes 41 and 42 forming part of the exhaust route of the compressor, an aspiration hole 43, and a recessed area 44. The area 44 is recessed with respect to the bottom surface 4B of the valve plate 40, as better explained below. The plate 40 is also provided with four holes 49 to accommodate bolts (not shown) that anchor the various parts of the compressor.

Figure 2:
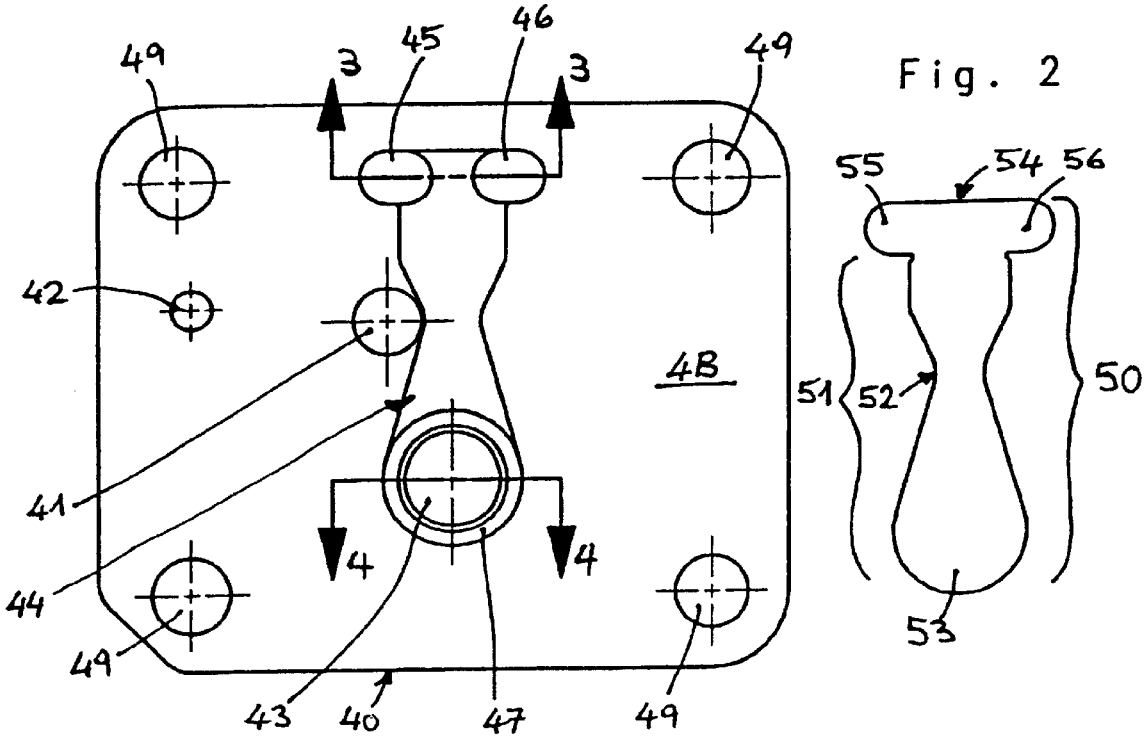
FIG. 2 is a front view of a valve plate and an aspiration valve of the compressor of FIG. 1.

The aspiration valve 50 in the present embodiment is a flat tongue having in design a shape substantially like a "T", as best shown in FIG. 2. The valve 50 comprises an elongated main portion 51 having a central narrow part 52 to expose exhaust hole 41, a free rounded end 53 that is capable of sealing the aspiration hole 43 (see FIG. 5), and a transverse anchoring portion 54 including two creased tabs 55 and 56 (see FIG. 6).

The compressor head 60 is joined to the cylinder body 10 by means of the previously mentioned four bolts which pass through the holes 49 of the valve plate 40.

The second flat sealing gasket 70 has top and bottom surfaces 70A, 70B. The gasket 70 has several openings, including an opening 71 corresponding to the aspiration hole 43 of the valve plate (see FIG. 1). Further, the gasket 70 provides an adequate seal between the valve plate 40 and the compressor head 60.

As previously mentioned, and illustrated in FIGS. 2–6, the recessed area 44 on the surface 4B of the valve body 40 is capable of accommodating the entire aspiration valve 50. As a result, the aspiration valve 50 does not substantially protrude into the cylinder 20 and the piston 25 may elevate to a position within the cylinder 20 such that a top surface 25A of the piston 25 is substantially level with a top surface 10A of the cylinder housing 10. This results in the potential for an increased volumetric yield of the compressor.

Figure 3:
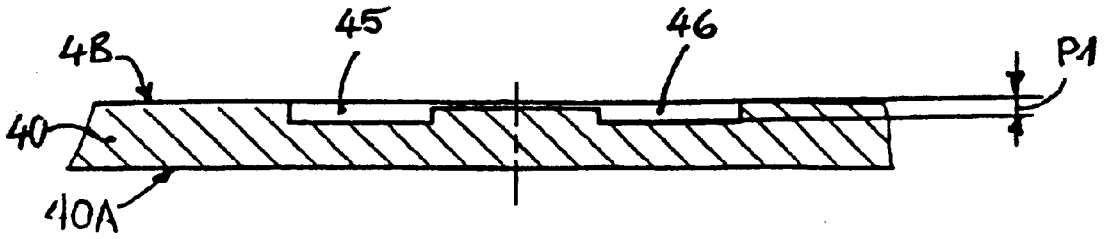
FIG. 3 is a transverse section of the valve plate taken along section line 3—3 of FIG. 2.
Figure 4:
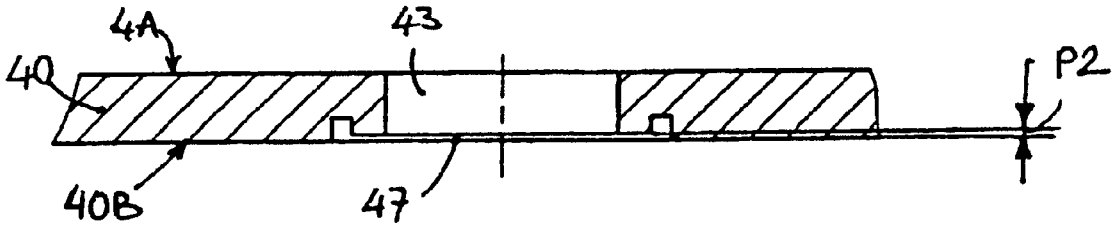
FIG. 4 is a transverse section of the valve plate taken along section line 4—4 of FIG. 2.
Figure 6:
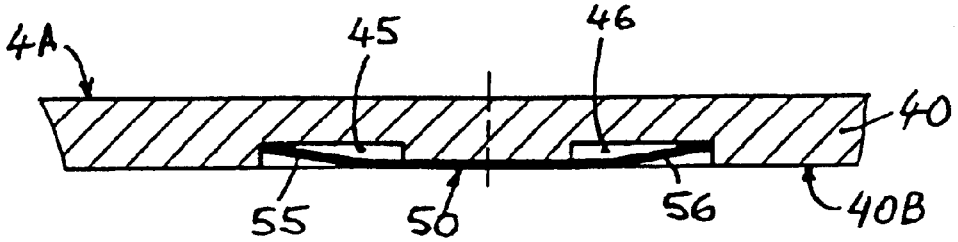
FIG. 6 is a transverse section of the valve plate taken along section line 6—6 of FIG. 5.

Specifically, as best shown in FIGS. 2 and 3, the recessed area 44 includes two indentations 45 and 46 in such a form and disposition to be able to accommodate with a calibrated interference the creased tabs 55 and 56 of the anchoring portion 54 of the valve 50 (see FIG. 6). Further, as best shown in FIGS. 2 and 4, the recessed area 44 includes a main indentation 47 that accommodates the elongated main portion 51 of the valve 50 (see FIG. 2). The depth P1 of the indentations 45 and 46 (see FIG. 3) is greater than the depth P2 of the main indentation 47 within the same recessed area 44 (see FIG. 4). This feature provides self-centering and minimal play between the aspiration valve 50 and the valve plate 40. As a result, the risk of loss of refrigerant gas from the perimeter of the valve is minimized.

Figure 5:
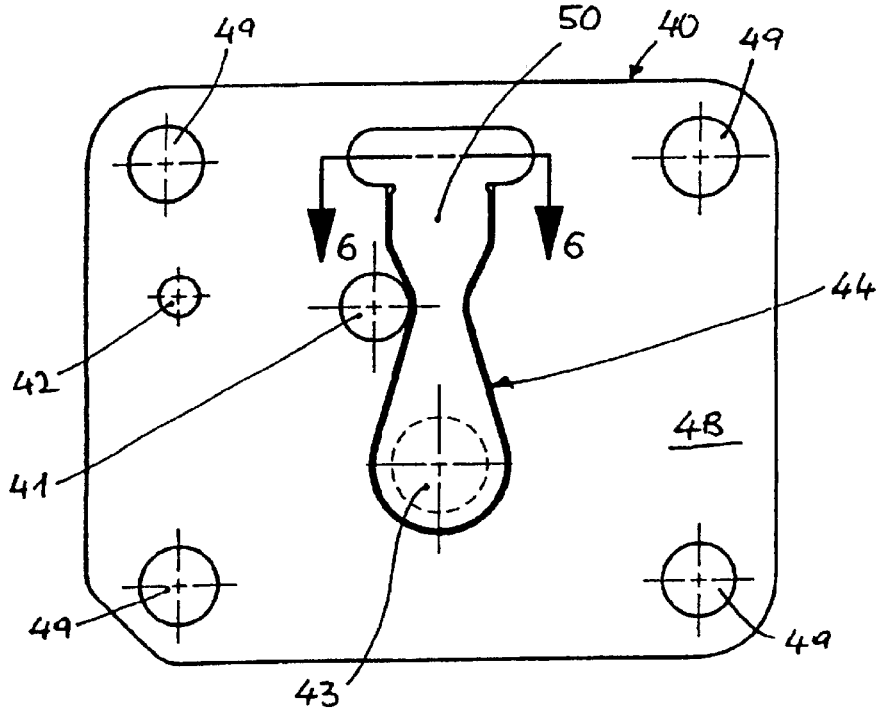
FIG. 5 is a front view of an aspiration valve positioned on a valve plate of the compressor of FIG. 1.

The free end 53 of the aspiration valve 50 is designed to have a shape and size sufficient to completely seal the aspiration hole 43 on the valve plate 40 (see FIG. 5). This seal is the only critical fit in the assembly of the compressor. Thus, the circular rim that surrounds the aspiration hole 43 is the only portion that must be machined after casting, thereby simplifying the manufacturing process.

Although a particular embodiment of the invention have been described in detail, it is understood that the invention is not limited correspondingly in scope, but includes all changes and modifications coming within the spirit and terms of the claims appended hereto, including aspiration valves having a different shape and valve plates having aspiration holes with a different disposition and/or orientation.

What is claimed is:

1. A compressor for an airtight refrigerating unit comprising:

a cylinder body;

a compressor head;

a valve plate held between the cylinder body and the compressor head with the interposition of a first flat sealing gasket and a second flat sealing gasket; and a thin-sheet aspiration valve associated with an aspiration hole provided on the valve plate, wherein substantially the entire aspiration valve is accommodated by a recessed area provided on a surface of the valve plate that is directed toward the cylinder body, wherein the recessed area comprises:

a main area which accommodates a main portion of the aspiration valve; and at least one other indentation having a depth greater than the depth of the main area, such that said other indentation is capable of accommodating an anchoring portion of the aspiration valve.

2. The compressor of claim 1, further comprising a piston provided within the cylinder and wherein the piston is capable of elevating to a position such that a top surface of the piston is substantially coplanar to a top surface of the cylinder body.

3. The compressor of claim 1, wherein the aspiration valve is a generally T-shaped flat tongue, said flat tongue comprising:

an elongated main portion having a free rounded end that is capable of sealing the aspiration hole of the valve plate; and a transverse anchoring portion that comprises at least one creased tab.

* * * * *